US006183205B1

(12) United States Patent
Iizuka et al.

(10) Patent No.: US 6,183,205 B1
(45) Date of Patent: Feb. 6, 2001

(54) INVERTER-CONTROLLED SEALED COMPRESSOR

(75) Inventors: Tatsuyuki Iizuka; Seigo Yanase, both of Fujisawa (JP)

(73) Assignee: Matsushita Refrigeration Company, Osaka (JP)

( * ) Notice: Under 35 U.S.C. 154(b), the term of this patent shall be extended for 0 days.

(21) Appl. No.: 09/117,981

(22) PCT Filed: Dec. 20, 1996

(86) PCT No.: PCT/JP96/03731

§ 371 Date: Aug. 11, 1998

§ 102(e) Date: Aug. 11, 1998

(87) PCT Pub. No.: WO97/31188

PCT Pub. Date: Aug. 28, 1997

(30) Foreign Application Priority Data

Feb. 20, 1996 (JP) ..... 8-031570

(51) Int. Cl.[7] ..... F04B 49/06
(52) U.S. Cl. ..... 417/44.1; 417/423.7
(58) Field of Search ..... 417/44.1, 145, 417/423.7; 62/228.4, 296

(56) References Cited

U.S. PATENT DOCUMENTS 3,691,785 * 9/1972 Ruff et al. ..... 62/230
5,493,868 * 2/1996 Kikuiri et al. ..... 62/129

FOREIGN PATENT DOCUMENTS 4-270864 * 9/1992 (JP) .
05126044 5/1993 (JP) .
07337057 12/1995 (JP) .
08086294 4/1996 (JP) .

* cited by examiner

*Primary Examiner*—Noah P. Kamen
*Assistant Examiner*—Mahmoud Gimie
(74) *Attorney, Agent, or Firm*—Wenderoth, Lind & Ponack, L.L.P.

(57) ABSTRACT

A sealed compressor for use in a refrigerator includes a sealed housing having an interior communicated to the outside of the sealed housing through a discharge tube, a compressor element accommodated within the sealed housing, an electric element accommodated within the sealed housing for driving the compressor element, and a coupling tube fluid-connecting the compressor element and the discharge tube within the sealed housing. To avoid a resonant motion of the coupling tube which would otherwise generate obnoxious noise, an inverter controller is employed to allow the electric element to be operated at one of a plurality of frequencies other than the resonance frequency of the coupling tube.

2 Claims, 2 Drawing Sheets

INVERTER-CONTROLLED SEALED COMPRESSOR

TECHNICAL FIELD

The present invention generally relates to a sealed compressor for use in refrigerating systems and, more particularly, to the sealed reciprocating compressor of a type controlled by an inverter controller to allow the compressor to provide a variable power.

BACKGROUND ART

A reciprocating compressor currently employed in a refrigerator for home use has no variable power feature and is generally operated at a predetermined power source frequency, for example, 50 or 60 Hz in Japan.

Also, the reciprocating compressor is generally of a structure wherein a sealed housing has a low internal pressure and employs a high pressure discharge tube through which a compressed gaseous medium is discharged to the outside of the sealed housing. An example of those reciprocating compressors is disclosed in Japanese Laid-open Patent Publication (unexamined) No. 5-126044.

For further discussion of the prior art reciprocating compressor, reference will be made to FIG. 3 of the accompanying drawings. The prior art reciprocating compressor shown therein comprises a generally cylindrical sealed housing 1 accommodating therein an electrical element (not shown) including a drive motor and a compressor element 6. The compressor element 6 comprises a cylinder 2, a cylinder head 3, a reciprocating piston 4 and a cranking member 5. The sealed housing 1 includes an exhaust muffler 7 disposed at a location laterally of the cylinder 2 and a discharge tube 8 extending completely across a wall of the sealed housing 1 and soldered to the sealed housing 1 at a portion thereof which extends through the wall of the sealed housing 1. The exhaust muffler 7 and the discharge tube 8 are connected with each other by means of a generally tortuous coupling tube 9 disposed inside the sealed housing 1. The sealed housing 1 also include a coil spring 10 mounted around the tortuous coupling tube 9 for resonance suppression.

In the prior art reciprocating compressor of the structure shown in FIG. 3, the electric element is operated at a predetermined power source frequency, for example, 50 or 60 Hz in Japan. Accordingly, the drive motor forming a part of the electric element is driven at a predetermined rotational speed at all times with its rotary drive translated by the cranking member 5 into a reciprocating motion that is assumed by the reciprocating piston 4 within the cylinder 2. The reciprocating motion of the piston 4 causes a gaseous refrigerant sucked from an external supply system (not shown) to be compressed and subsequently discharged to the exhaust muffler 7 through the cylinder head 3. The compressed refrigerant in the exhaust muffler 7 flows through the coupling tube 9 and then to the outside of the sealed housing 1 through the discharge tube 8.

During the flow of the compressed refrigerant through the coupling tube 9, the coupling tube 9 is apt to generate obnoxious noise in resonance to a pulsating motion of the compressed refrigerant within the coupling tube 9 and the operating frequency of the electric element. However, generation of the obnoxious noise is suppressed by the use of the coil spring 10.

On the other hand, in the refrigerator for home use, the need has been realized to lower the output capacity during a low load operating condition to thereby minimize a power consumption. In other words, although the coupling tube 9 employed in the prior art reciprocating compressor is designed to successfully suppress resonance when the reciprocating compressor is operated at the specific frequency of 50 or 60 Hz, the prior art reciprocating compressor still has a problem associated with the resonance of the coupling tube 9 when operated at a low frequency. Therefore, no variable-capacity refrigerator for home use has yet been made available in the market.

Accordingly, the present invention is intended to provide an improved compressor having a variable power that is substantially free from the problem associated with resonance.

DISCLOSURE OF THE INVENTION

In accomplishing the above and other objectives, the present invention makes use of an inverter controller with which the electric element of the sealed compressor can be operated at a frequency effective to avoid resonance of the coupling tube. The frequency at which the coupling tube tends to resonate can be determined empirically.

More specifically, the sealed compressor according to the present invention comprises a sealed housing having an interior communicated to outside thereof through a discharge tube, a compressor element accommodated within the sealed housing, an electric element accommodated within the sealed housing for driving the compressor element, and a coupling tube fluid-connecting the compressor element and the discharge tube within the sealed housing. This sealed compressor is characterized by an inverter controller which can operate the electric element at a plurality of operating frequencies other than the frequency at which the coupling tube tends to undergo a resonant motion for operating the electric element at one of these frequencies.

Preferably, at least one of the operating frequencies other than the frequency of resonance of the coupling tube is equal to or substantially equal to the power source frequency, that is, the frequency of the electric power available from a commercial power outlet. This is particularly advantageous in that no design change may be made to the existing coupling tube and the electric element can be driven without being accompanied by the undesirable resonance of the coupling tube.

BRIEF DESCRIPTION OF THE DRAWINGS

For better understanding of the present invention, reference will be made to the accompanying drawings in which like parts are designated by like reference numerals and in which.

DETAILED DESCRIPTION OF THE PREFERRED EMBODIMENTS

Figure 1:
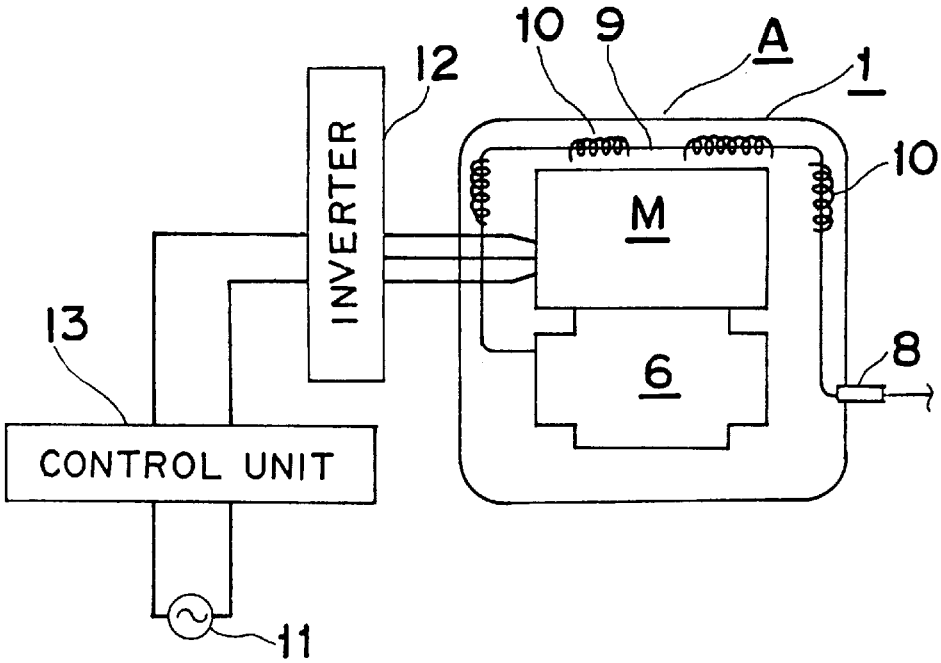
FIG. 1 is a circuit block diagram showing a control system for a refrigerator employing a reciprocating compressor, which embodies the present invention.

Referring first to FIG. 1, a variable-power compressor A embodying the present invention comprises a generally cylindrical sealed housing 1, an electric element M accommodated within the sealed housing 1 and a reciprocating compressor element 6 also accommodated within the sealed housing 1. As is the case with the prior art reciprocating compressor shown in FIG. 3, a discharge tube 8 extends completely across a wall of the sealed housing 1 and is soldered to the sealed housing 1 at a portion thereof which extends through the wall of the sealed housing 1. An exhaust muffler (not shown) and the discharge tube 8 are connected with each other by means of a generally tortuous coupling tube 9 disposed inside the sealed housing 1. The sealed housing 1 also includes a plurality of coil springs 10 mounted around the tortuous coupling tube 9 for resonance suppression.

The electric element M is operated at a frequency matching with the frequency of the electric power available from a commercial power outlet 11, that is, the power source frequency, and also at a frequency controlled by an inverter controller 12. Reference numeral 13 represents a refrigerator control unit which may be well-known to those skilled in the art.

Figure 3:
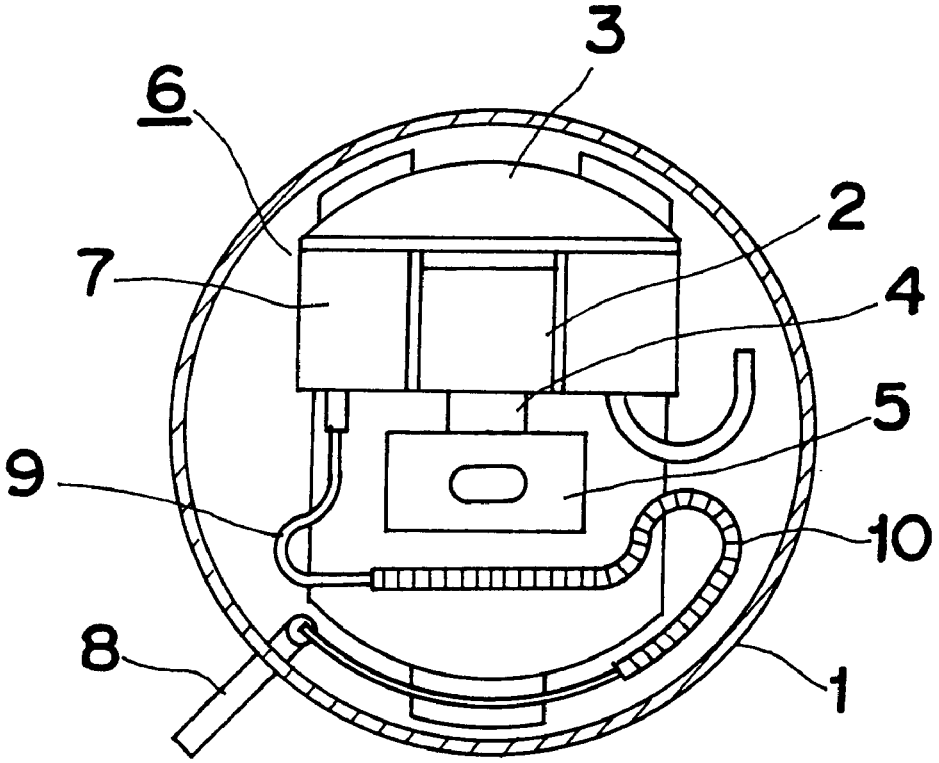
FIG. 3 is a schematic transverse sectional view of the prior art reciprocating compressor.

The compressor embodying the present invention is operated in a manner similar to the prior art reciprocating compressor shown in FIG. 3. Briefly speaking, the electric element M is operated at the power source frequency and, during the operation of the electric element M, a compressed refrigerant gas is discharged through the discharge tube 8 to the outside of the sealed housing 1. The coil springs 10 similarly serve to suppress the resonant motion of the coupling tube 9.

Figure 2:
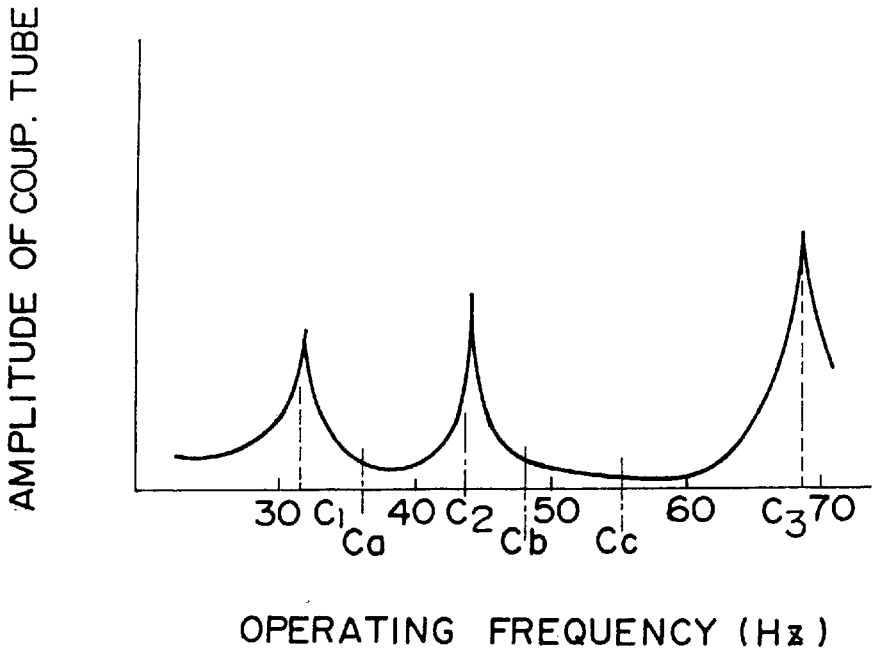
FIG. 2 is a graph showing the relationship between the operating frequency of an electric element of the reciprocating compressor and the amplitude of a coupling tube employed therein.

As shown in FIG. 2, a series of experiments conducted have revealed that even though the coil springs 10 are employed, the coupling tube 9 has a plurality of resonance frequencies at which it undergoes vibration. As shown therein, those resonance frequencies match respectively with relatively low operating frequencies C1, C2, C3, and so on, at which the electric element M is operated. Based on the empirical data, the inverter controller 12 employed in the practice of the present invention is so designed as to supply to the electric element M an electric power of one of a plurality of operating frequencies Ca, Cb, Cc, and so on, other than those resonance frequencies of the coupling tube 9. Accordingly, even if during a low load operating condition of the refrigerator the frequency at which the electric element M is driven is lowered down to any one of the frequencies Ca, Cb and Cc for power saving, the coupling tube 9 will undergo no resonant motion and hence be accompanied by no noise.

So far as the territory of Japan is concerned, the power source frequency is fixed 50 Hz in a northern part of Japan and 60 Hz in a southern part of Japan. Accordingly, so long as the electric element M is operated at 50 or 60 Hz, the coupling tube 9 does not undergo any resonant motion because of the use of the coil springs 10. In order for any existing coupling tube to be employed without being altered or modified in design in any way whatsoever, at least one of the frequencies controlled by the inverter controller employed in the present invention is preferably set to 50 or 60 Hz.

Although the present invention has been described in connection with the preferred embodiment thereof with reference to the accompanying drawings, it is to be noted that various changes and modifications are apparent to those skilled in the art. For example, although in the foregoing embodiment the present invention has been shown and described as applied to the reciprocating compressor, the present invention can be equally applied to a rotary compressor of a type employing a housing having a low internal pressure.

What is claimed is:

1. A sealed compressor for use with a commercial power source outputting electric power at a predetermined frequency, said compressor comprising:

a sealed housing having an interior communicated to outside thereof through a discharge tube;

a compressor element accommodated within the sealed housing;

an electric element accommodated within the sealed housing for driving the compressor element;

a coupling tube fluid-connecting the compressor element and the discharge tube within the sealed housing; and an inverter controller for operating the electric element at a plurality of operating frequencies other than the frequency at which the coupling tube tends to undergo a resonant motion, the plurality of operating frequencies being lower than or equal to the predetermined frequency of the electric power outputted from the commercial power source to which the compressor is to be connected.

2. The sealed compressor according to claim 1, wherein at least one of the operating frequencies, other than the frequency of resonance of the coupling tube, is equal to or substantially equal to the frequency of the electric power available from the commercial power outlet to which the compressor is to be connected.

* * * * *